United States Patent [19]

Esopi

[11] Patent Number: 4,712,732

[45] Date of Patent: Dec. 15, 1987

[54] REVERSIBLE MAILBOX SIGNALING DEVICE

[76] Inventor: Aldo Esopi, 929 Belford Rd., Allentown, Pa. 18103

[21] Appl. No.: 6,220

[22] Filed: Jan. 23, 1987

[51] Int. Cl.[4] ..... A47G 29/12

[52] U.S. Cl. ..... 232/35

[58] Field of Search ..... 232/17, 34, 35

[56] References Cited

U.S. PATENT DOCUMENTS

| | | | |
|---|---|---|---|
| 2,352,975 | 7/1944 | Roe | 232/35 |
| 2,988,268 | 6/1961 | Miodreski | 232/35 |
| 3,602,424 | 8/1971 | Raulston | 232/35 |
| 3,623,655 | 11/1971 | Tieszen | 232/35 |
| 3,747,839 | 7/1973 | Morton | 232/35 |
| 4,365,740 | 12/1982 | Whitley et al. | 232/35 |

*Primary Examiner*—Robert W. Gibson, Jr.
*Attorney, Agent, or Firm*—Ruth Moyerman

[57] ABSTRACT

A transposable dual mode mailbox signaling device for mounting on either side of a rural mailbox is disclosed. A housing attachable to either side of a mailbox proximate the mailbox door has a front face, back face, a proximal end, including a centered elongated aperture to receive a flagstaff flange, and an open distal end, an open top edge and an open bottom edge. A longitudinally symmetrical flagstaff is mounted within the housing for pivotal movement about its horizontal axis. The flagstaff has an opposing pair of horizontal flanges at the lower end as well as a downward projecting flange at the flagstaff's lower edge. Each flange is sized to fit through the proximal edge's aperture. A longitudinally symmetrical flag is attached to the flagstaff's other end. A reversible rod attachable to a mailbox door includes a detent to retain a corresponding horizontal flange when the flag is up. When the rod to retain the horizontal flange in place is removed by opening the mailbox door, the flag falls approximately 180 degrees by gravity until engaging the proximal end. An alternate embodiment includes a reversible and disengageable stop proximate the distal end to retain the flag at approximately 90 degrees. Another alternate embodiment includes a leaf spring to aid the gravity fall.

6 Claims, 6 Drawing Figures

FIG. 1
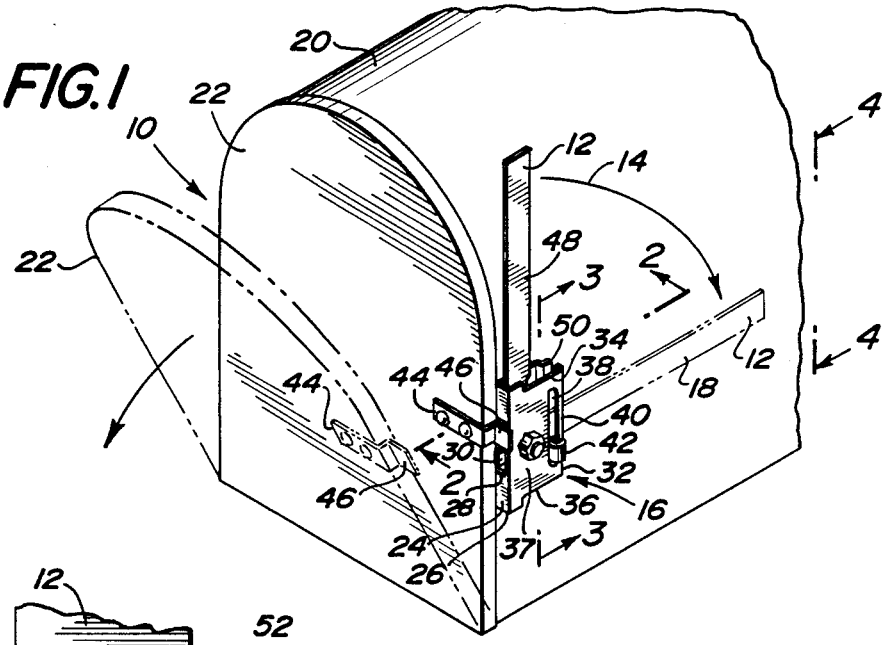
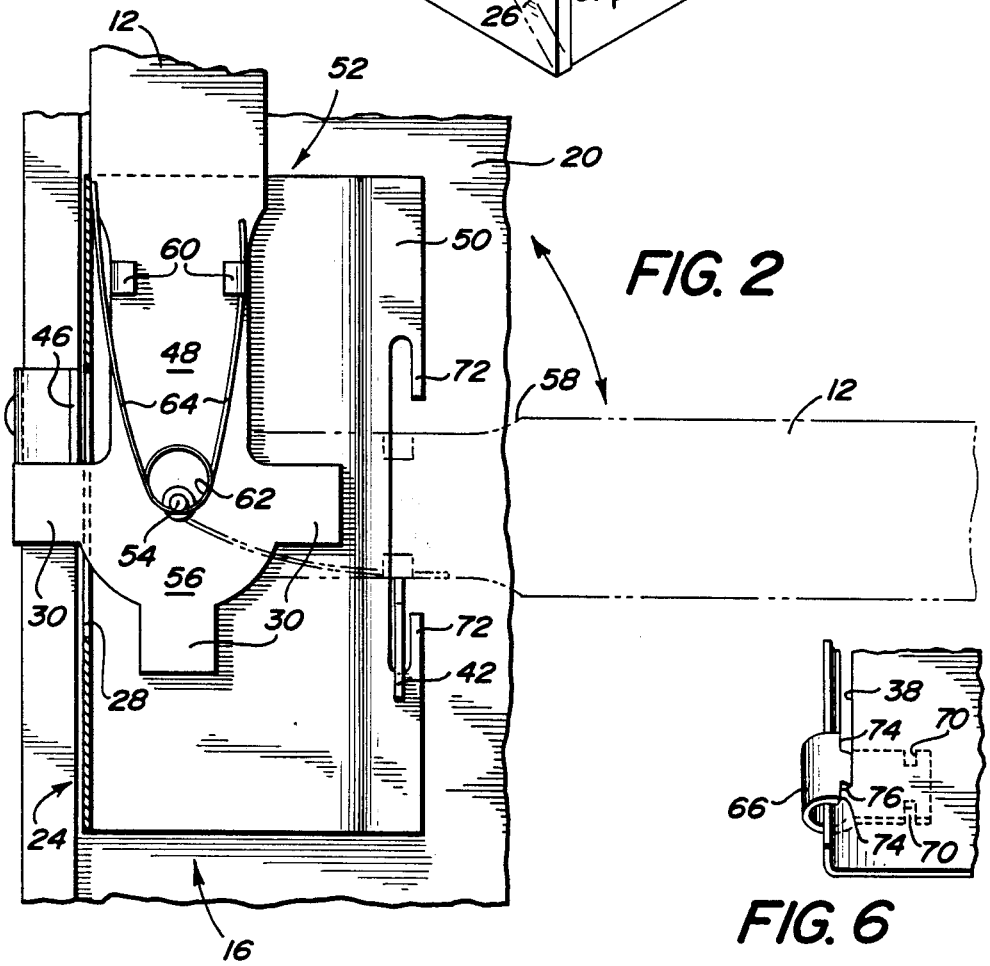
FIG. 2
FIG. 6

REVERSIBLE MAILBOX SIGNALING DEVICE

BACKGROUND OF THE INVENTION

1. Field of the Invention

This invention relates to mailboxes and more particularly to a transposable, dual mode mailbox signaling device.

2. Description of the Prior Art

Signaling devices for rural mailboxes are well known in the art. They serve as a convenient means to alert a rural mail carrier that there is mail to be picked up in a particular box regardless of whether or not he has any pieces to deliver. Likewise, rural residents enjoy an appropriate visible signal to alert them that the mail has been delivered. The visible signaling devices save time and energy as the rural resident does not have to take time for a "wild goose chase" to ascertain whether or not the mail has been or is yet to be delivered.

The typical signal flag or flags usually have an "up" position to indicate to the mail carrier there is mail to be picked up and a "down" position to indicate to the resident that mail has been delivered. In some cases the positions are reversed. These devices operate in any number of ways; for example, manually, gravity fall, spring release, weight release and/or magnets. Common examples of such prior art are U.S. Pat. No. 4,186,870 to Walden who discloses a flag asembly whereby the opening of the door causes a spring-actuated rod projection to contact a flag assembly, thereby causing a rotational movement of the flag to a lowered position. U.S. Pat. No. 4,290,549 to Getz, Jr., discloses a first side flag which returns to a stored position when the postman opens the door, and a second optional rear flag which raises to notify the homeowner if the mailman has stopped. U.S. Pat. No. 4,344,559 to Widham discloses a device, coordinated by two ferromagnetic strips, with a casing receiving a flag with lateral play for movement into a raised "no mail" and a lowered "mail delivered" position. U.S. Pat. No. 4,596,357 to File discloses a complicated device with a weighted control cord which activates a plate to a visible or non-visible position.

No device is known that is symmetrical on its horizontal axis and therefore transposable, with a dual mode and thereby capable of being attached to either side of the mailbox. Also, no device is known that shows a signal with the option of the intermediate stop or choice of stops.

SUMMARY OF THE INVENTION

The aforementioned prior art problems are obviated by the device of this invention in which a transposable, dual mode mailbox signaling device for mounting on either side of a rural mailbox is provided. A housing symmetrical along its horizontal axis includes a front face, a back face, a proximal end serving as a first stop and including a centered elongated aperture to receive a flagstaff flange, an open distal end, an open top edge and an open bottom edge. A longitudinally symmetrical flagstaff is mounted within the housing for pivotal movement about its horizontal axis. The flagstaff has an opposing pair of horizontal flanges at the lower end as well as a downward projecting flange at the flagstaff's lower edge. Each flange is sized to fit through the aperture at the proximate edge. A longitudinally symmetrical flag is attached to the flagstaff's other end.

A reversible rod attached to the mailbox door includes a detent to retain, depending on which side of the mailbox the housing is mounted, a corresponding horizontal flange of the flagstaff when the flag is up. A reversible and disengageable second stop includes a longitudinal slot to create a sleeve guide on the front face proximate the distal end. The sleeve guide holds a slideable, permanently affixed sleeve and a tab attached to the sleeve. The tab includes opposing longitudinal slits. The back face also includes a broken slot opposing the front face slot. The back face's slot's break forms a pair of hooks. One hook mates with a corresponding tab slit depending on which side of the mailbox the device is attached. When the rod to retain the horizontal flange in place is removed by opening the mailbox door, the flag falls by gravity until engaging one of the two stops.

An alternate embodiment includes a leaf spring to aid the gravity fall.

It is therefore an object of this invention to provide a device that is symmetrical and therefore reversible or capable of being attached to either side of a mailbox by a 180 degree turn.

It is a further object of this invention to show a flag signal with the option of an intermediate stop or choice of stops.

It is still another object of this invention to provide a device where the flag can be set in a stored position as not to alert a potential thief if a resident is temporarily away from home.

It is yet another object of this invention to provide a device that can be easily attached to most existing mailboxes with no modifications.

These and other objects will be more readily ascertainable to one skilled in the art from a consideration of the following Figures, description and exemplary embodiments.

BRIEF DESCRIPTION OF THE DRAWING(S)

FIG. 1 is a schematic view of this invention showing the flag in the up (or mail carrier signal) position and in the intermediate stop-stored position in phantom.

FIG. 2 is a cross section view of the back face and flag assembly taken along lines 2—2 of FIG. 1.

FIG. 6 is a fragmentary view of this invention showing the sleeve slit fitting into the longitudinal slot.

DETAILED DESCRIPTION OF THE PREFERRED EMBODIMENT(S)

Figure 3:
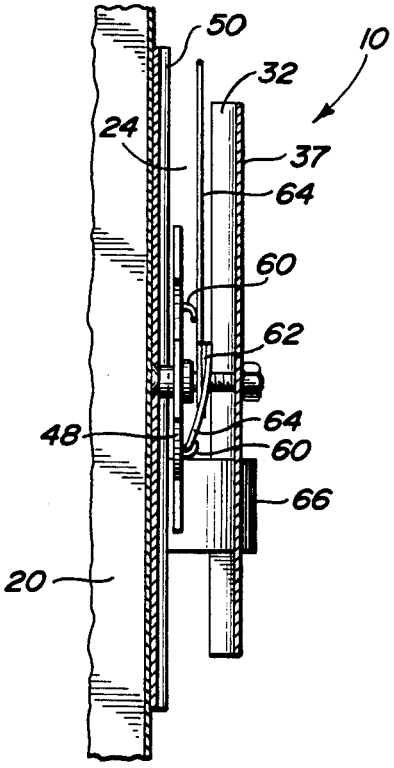
FIG. 3 is a cross section taken along lines 3—3 of FIG. 1.

Referring now to the figures and more particularly to FIG. 1, FIG. 1 shows a schematic view of device 10 with flag 12 in the up position and fallen in the direction of arrow 14 to the intermediate stored position (in phantom). Housing 16, generally symmetrical along its horizontal axis as indicated by line 18, is attachable to either side of mailbox 20 proximate mailbox door 22. Housing 16 is attached to mailbox 20 through back face 50 and includes proximal end 24 serving as a first stop at bottom 26. Proximal end 24 also includes centered elongated aperture 28 to receive flagstaff flange 30. Housing 16 additionally includes front face 37 and back face 50, open distal end 32, open top edge 34 and open bottom edge 36. Front face 37 of housing 16 includes longitudinal slot 38 proximate distal end 32 to create sleeve guide 40. Second stop 42 is attached to sleeve guide 40. The function of second stop 42 will be explained in detail in FIG. 4.

Reversible retainer 44 with detent at 46 (shown on closed door 22 and open door 22 in phantom) is attached to door 22 to retain, depending on which side of mailbox 20 housing 16 is mounted, corresponding flange 30 of flagstaff 48 which projects through aperture 28 when flag 12 is up. Flag 12 is manually set in the up position by the homeowner.

As shown in FIG. 1 in phantom, retainer 44 has been pulled away, thereby releasing flange 30 of flag 12 and flagstaff 48. Flag 12 has fallen approximately 90 degrees by gravity through top edge 34 until becoming engaged with second stop 42. A fall of 90 degrees places flag 12 in the stored position.

Referring now to FIG. 2, a cross section view of back face 50 and flag assembly 52 taken along lines 2—2 of FIG. 1 is shown. Flag assembly 52 includes longitudinally symmetrical flagstaff 48 mounted on back face 50 of housing 16 for pivotal movement about its horizontal axis at 54. Flagstaff 48 has opposing horizontal flanges 30 and downward projecting flange 30 at end 56. Each flange 30 is sized to fit through aperture 28 at proximal end 24 of housing 16. Longitudinally symmetrical flag 12 is attached to other end 58 of flagstaff 48. Detent 46 holds left side flange 30 to secure flag 12 in an upward position as manually set by the user.

Flagstaff 48 includes clips 60 and leaf spring 62 with leaves 64 engaging one of clips 60 to aid in the fall of flag assembly 52. The clip engaged depends upon which side of mailbox 20 housing 16 is attached. In this view, right leaf 64 is held by right clip 60. In phantom, flagstaff 12 has fallen approximately 90 degrees and has been halted by second stop 42 being secured by corresponding hook 72.

Figure 4:
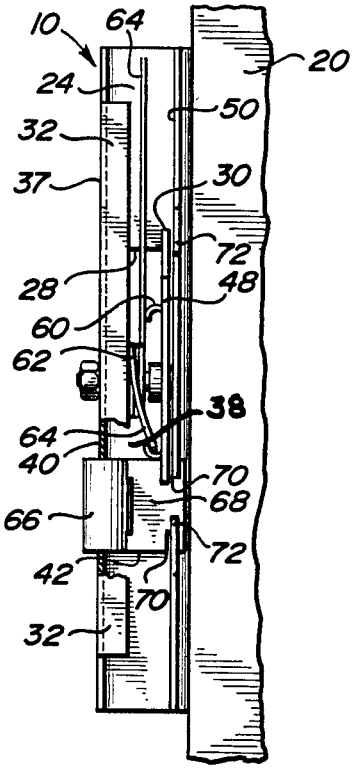
FIG. 4 is a cross section taken along lines 4—4 of FIG. 1.

Referring now to FIGS. 3 and 4, collectively, cross sections along lines 3—3 and 4—4 of FIG. 1 are shown. Device 10 has been attached to mailbox 20 at back face 50. For easier orientation, front face 37, distal end 32 and proximal end 24 are indicated. Leaves 64 of leaf spring 62 are held in place by clips 60 on flagstaff 48.

Referring more particularly to FIG. 4, the function of second stop 42 will be explained. Second stop 42, including permanently affixed sleeve 66 and tab 68, is slidable along sleeve guide 40 formed by longitudinal slot 38 in front face 37. Tab 68 includes a second pair of opposing longitudinal slits 70. Back face 50 includes a broken slot that forms a pair of hooks 72, one each to mate with a corresponding slit 70 depending upon which side of mailbox 20 device 10 is attached. When second stop 42 is engaged (depending upon which side of the mailbox the device is mounted) by the mating of one slit 70 with a corresponding hook 72, flagstaff 48 will fall only approximately 90 degrees to the stored position as shown in phantom in FIGS. 1 and 2. When second stop 42 is disengaged, as shown in FIG. 5, flagstaff 48 will fall approximately 180 degrees to alert the homeowner that mail has been delivered.

Figure 5:
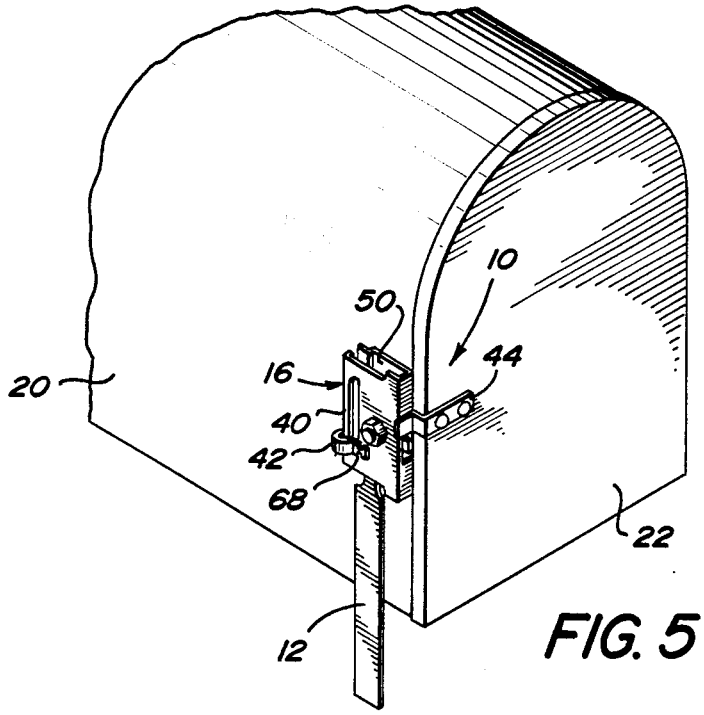
FIG. 5 is a schematic view of this invention showing the device transposed on the other side of the mailbox with the intermediate stop disengaged and the flag in the down position.

Referring now to FIG. 5, a schematic view of device 10 is shown transposed on the other side of mailbox 20. Retainer 44 on mailbox door 22 and housing 16 on mailbox 20 have been rotated 180 degrees and transposed to the other side. Note that second stop 42, held by sleeve guide 40, has been released by removing tab 68 of sleeve 66 from a hook (not shown) in back face 50. Flag 12 has therefore fallen approximately 180 degrees and is in the down position to alert the homeowner that mail has been delivered.

Referring now to FIG. 6, a fragmentary view of device 10 shows one of a first pair of slits 74 fitting into bottom 76 of longitudinal slot 38 to prevent rotation of sleeve 66 about its vertical axis so that one of a second pair of slits 70 cannot be engaged and set device 10 into a second stop mode.

There are many variations which may be practiced and still be within the scope of this invention. While a spring is shown as an alternate embodiment, it is merely a suggestion and not critical to the invention.

While the preferred embodiment of the second stop are illustrated, any modification which performs this function may be used and still be within the scope of the invention.

Likewise, while the retainer on the mailbox door is illustrated, any modification serving the same function would still be within the scope of the invention.

Also, while the top and bottom edges are shown with collars, this is merely a method used to make the mounting screws accessible and are not critical to the invention.

The device of this invention has many advantages. Chiefly among these is that the device is transposable to either side of the mailbox.

Also, the device has a dual mode in that the flag can be stored at the intermediate stop so as not to alert a potential thief if a resident is temporarily away from home. Alternately, the flag can be dropped the full 180 degrees to alert a rural resident that mail has been delivered.

Lastly, the device can be attached to any mailbox without modification to the mailbox or mailbox door.

Having now illustrated and described my invention, it is not intended that such description limit the invention, but that the invention be limited only by a reasonable interpretation of the appended claims.

What is claimed is:

1. A transposable, dual mode mailbox signaling device for mounting on either side of a rural mailbox, said device comprising:

(a) a housing generally symmetrical along its horizontal axis, attachable to either side of a mailbox proximate the mailbox door, said housing including a front face, a proximal end serving as a first stop and including a centered elongated aperture to receive a flagstaff flange, and an open distal end, an open top edge and an open bottom edge;

(b) a longitudinally symmetrical, generally planar flagstaff, said flagstaff having a first and second end and two sides and two parallel edges, said flagstaff mounted at its first end within said housing for pivotal movement about its horizontal axis, said flagstaff first end also including an opposing pair of flanges, said opposing flanges being planar extensions of said flagstaff edges and perpendicular to the longitudinal axis of said flagstaff, and a third flange projecting in the same longitudinal axis as said flagstaff at said flagstaff's first end, each said flange sized to fit through said housing's proximal edge's aperture;

(c) a generally longitudinally symmetrical flag attached to said flagstaff's other end; and (d) reversible means attachable to a mailbox door, said means including a detent to retain, depending on which side of said mailbox said housing is mounted, one of said corresponding opposing flanges of said flagstaff when said flag extends from said open top edge, whereby, when said means to retain one of said opposing flanges in place is removed by opening said mailbox door, said flag falls approximately 180 degrees by gravity, through said housing's top edge, distal end and bottom edge, until engaging said housing's proximal end as a said first stop.

2. The device according to claim 1 wherein said flagstaff includes at least one clip and said pivotal mount includes a leaf spring with said spring's leaves engaging one of said clips.

3. The device according to claim 1 wherein said housing includes a second reversible and a disengageable stop to retain said flag at approximately a 90 degree fall.

4. The device according to claim 3 wherein said housing also includes a back face.

5. The device according to claim 4 wherein said front face includes a longitudinal slot proximate said distal end to create a sleeve guide and wherein a second stop attached to said sleeve guide includes a slideable, permanently affixed sleeve and a tab attached to said sleeve, said sleeve including a pair of opposing longitudinal slits at the intersection of said sleeve and said tab to prevent rotation of said sleeve about its vertical axis, said tab including a second pair of opposing longitudinal slits; and said back face also includes a borken slot opposing said front face slot, said back face's slot's break forming a pair of hooks, one each to mate with a corresponding said tab slit depending on which side of said mailbox said device is attached.

6. A transposable, dual mode mailbox signaling device for mounting on either side of a rural mailbox, said device comprising:

(a) a housing symmetrical along its horizontal axis, attachable to either side of a mailbox proximate the mailbox door, said housing including a proximal end serving as a first stop and including a centered elongated aperture to receive a flagstaff flange, and an open distal end, an open top edge and an open bottom edge; a front face including a longitudinal slot proximate said distal end to create a sleeve guide and a second stop attached to said sleeve guide, said second stop including a slideable, permanently affixed sleeve and a tab attached to said sleeve, said sleeve including a pair of opposing longitudinal slits at the intersection of said sleeve and said tab to prevent rotation of said sleeve about its vertical axis, said tab including a second pair of opposing longitudinal slits; and a back face including a broken slot opposing said longitudinal slot in said front face, said back face's slot's break forming a pair of hooks, one each to mate with a corresponding said tab slit depending on which side of said mailbox said device is attached;

(b) a longitudinally symmetrical, generally planar flagstaff, said flagstaff having a first and second end and two sides and two parallel edges, said flagstaff mounted at its first end within said housing for pivotal movement about its horizontal axis, said flagstaff first end also including an opposing pair of flanges, said opposing flanges being planar extensions of said flagstaff edges and perpendicular to the longitudinal axis of said flagstaff, and a third flange projecting in the same longitudinal axis as said flagstaff at said flagstaff's first end, each said flange sized to fit through said housing's proximal end's aperture;

(c) a longitudinally symmetrical flag attached to said flagstaff's other end; and (d) reversible means attachable to a mailbox door, said means including a detent to retain, depending on which side of said mailbox said housing is mounted, one of said corresponding opposing flanges of said flagstaff when said flag extends from said open top edge, whereby when said means to retain one of said opposing flanges in place is removed by opening said mailbox door, said flag falls by gravity until engaging one of two said stops.

* * * * *